US008454335B2

(12) United States Patent
Shepard

(10) Patent No.: US 8,454,335 B2
(45) Date of Patent: Jun. 4, 2013

(54) VALVELESS VANE COMPRESSOR

(75) Inventor: Charles Shepard, DeKalb, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 283 days.

(21) Appl. No.: 13/005,737

(22) Filed: Jan. 13, 2011

(65) Prior Publication Data

US 2012/0183425 A1 Jul. 19, 2012

(51) Int. Cl.
*F03C 2/00* (2006.01)
*F03C 4/00* (2006.01)
*F04C 2/00* (2006.01)

(52) U.S. Cl.
USPC ..... 418/259; 418/15; 418/260; 418/268

(58) Field of Classification Search
USPC ..... 418/15, 259, 260, 266–268, 150
See application file for complete search history.

(56) References Cited

U.S. PATENT DOCUMENTS 2,126,247 A 8/1938 Eppers
2,312,961 A * 3/1943 Cowherd ..... 418/269
2,417,568 A * 3/1947 Reilich ..... 418/257
2,786,422 A 3/1957 Rosaen et al.
2,832,199 A * 4/1958 Adams et al. ..... 418/15
3,373,929 A 3/1968 Partain
4,355,965 A 10/1982 Lowther
4,480,973 A * 11/1984 Ishizuka ..... 418/259
4,501,537 A * 2/1985 Ishizuka ..... 418/259
4,566,869 A * 1/1986 Pandeya et al. ..... 418/15
4,770,612 A * 9/1988 Teubler ..... 418/133
4,978,279 A 12/1990 Rodgers
5,116,208 A 5/1992 Parme
5,154,593 A * 10/1992 Konishi et al. ..... 418/268
5,235,803 A 8/1993 Rodgers
6,135,720 A 10/2000 Boller
6,503,064 B1 * 1/2003 Croke et al. ..... 418/259
7,140,839 B2 11/2006 McAuliffe et al.

* cited by examiner

*Primary Examiner* — Theresa Trieu
(74) *Attorney, Agent, or Firm* — Carlson, Gaskey & Olds, P.C.

(57) ABSTRACT

A vane compressor has a plurality of vanes that are radially translatable and have outer ends. The vanes create zones between each pair of adjacent vanes, each zone having a given area. The vane compressor also has an axis about which the vanes rotate and an outlet for expelling compressed fluid. A first zone immediately following a second zone, which is in register with the outlet, has the same area as the second zone.

7 Claims, 1 Drawing Sheet

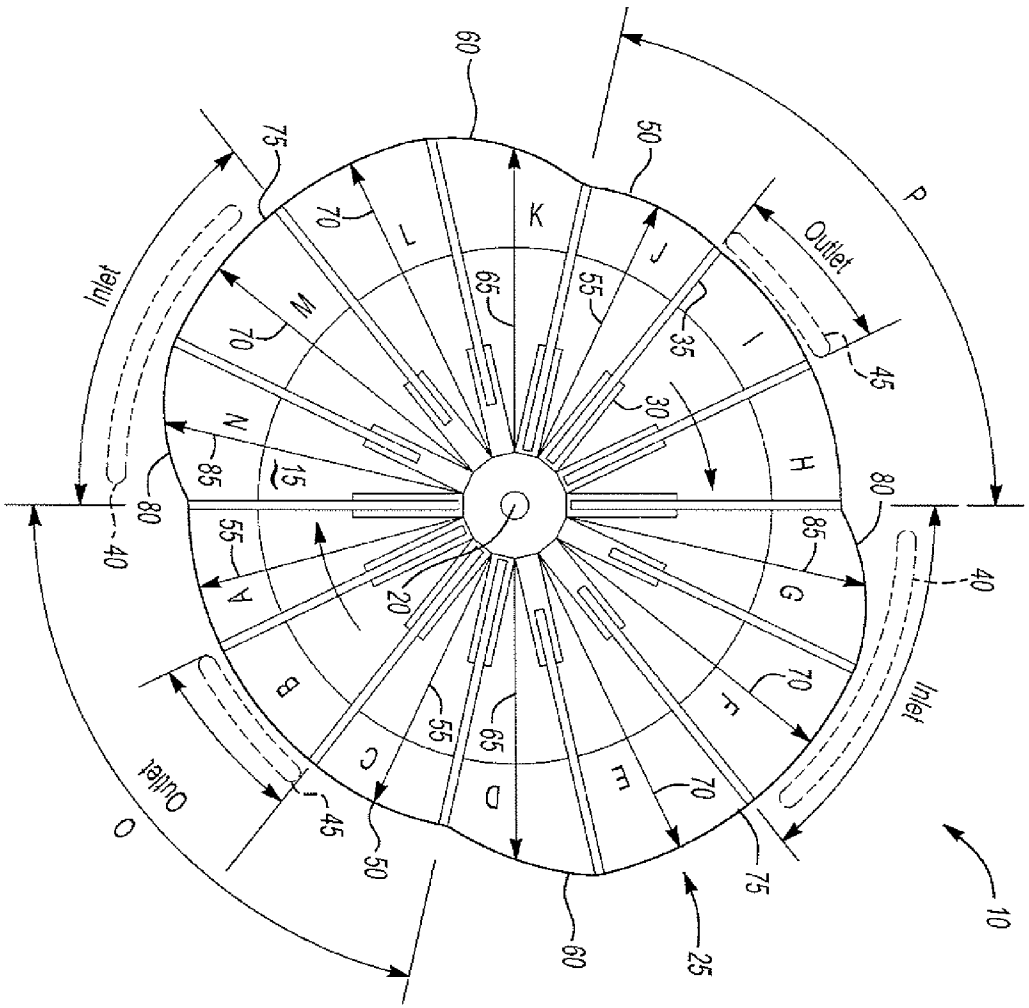
10
40
Inlet
80
85
G
70
F
75
25
70
E
60
D
65
55
50
C
45
B
A
55
85
80
40
Inlet
O
Outlet
45
75
70
N
70
M
70
L
60
65
K
50
J
55
35
30
I
H
P
Outlet
15
20

VALVELESS VANE COMPRESSOR

BACKGROUND

This application relates to vane compressors, and more particularly to a valveless vane compressor.

Vane compressors compress fluids, such as gas, and are well known in the art. A vane compressor may have internal disk in which a plurality of vanes are free to move in and out of the disk. The vanes follow an outer circumference and take in fluid when the vanes are extended from the disk, and compress the fluid as the vanes follow the circumference and contract thereby lessening the area in which the fluid is entrapped. The compressed fluid is pushed out of a fluid outlet. To prevent the fluid from back flowing into a vane compressor, valves are typically disposed within the fluid outlet to prevent such back flow. As the compressor drive shaft rotates, the vanes slide in and out to make contact with the compressor wall. Fluid enters at the largest opening and the compressed fluid discharges from the smallest opening. Vane compressors may utilize a centered drive shaft and a shaped outer surface or an offset drive shaft and a circular outer surface.

SUMMARY

According to an example disclosed herein, a vane compressor has a plurality of vanes that are radially translatable and have outer ends. The vanes create zones between each pair of adjacent vanes, each zone having a given area. The vane compressor also has an axis about which the vanes rotate and an outlet for expelling compressed fluid. A first zone immediately following a second zone that is in register with the outlet has the same area as the second zone.

According to a further example disclosed herein, a method of compressing fluid is provided. The method includes the steps of inletting a fluid having a first area; compressing the fluid by decreasing the first area to a smaller second area; rotating the second area to a first zone immediately leading a second zone having an outlet; rotating the second area to the second zone; and outletting the fluid from the second zone to reduce backflow from the outlet.

BRIEF DESCRIPTION OF THE DRAWINGS

The various features and advantages of the disclosed examples will become apparent to those skilled in the art from the following detailed description. The drawings that accompany the detailed description can be briefly described as follows.

The FIGURE shows a schematic view, partially in phantom, of a vane compressor as described herein.

DETAILED DESCRIPTION OF THE PREFERRED EMBODIMENT

Referring to the FIGURE, a vane compressor 10 is shown. The vane compressor 10 is of the balance type, however, one of ordinary skill would recognize that this teachings may be usable in other types of vane compressors, balanced or non-balanced, and with central off center drives or centered drives, etc. The vane compressor 10 has a disk 15 that rotates about axis 20, a cam surface 25, slots 30, vanes 35, inlets 40 and outlets 45. The dimensions shown in the FIGURE are exaggerated for ease of observation. As shown herein, the vane compressor 10 rotates in a clockwise direction.

Within the disk 15, the vanes 35 translate during rotation of the disk 15 within the slots 30 so that there is contact between the cam surface 25 and the vanes 35. The vane compressor 10 is a balanced vane compressor and has two inlets 40 and two outlets 45 distributed around and through the cam surface 25. Though fourteen vanes 35 are shown herein, one of ordinary skill will recognize that other numbers of vanes 35 are utilizable herein.

As the disk 15 and the vanes 35 rotate, areas or zones of variable size are created circumferentially between the vanes 35. As shown in the FIGURE, there are 14 zones designated from A to N as will be discussed herein.

Zones A, B and C, which all have the same or similar area, form an outlet zone O. Zone B is in register with an outlet 45 of outlet zone O. Similarly, zones H, I and J, which all have the same or similar area, form a similar outlet zone P where zone I is in register with outlet 45 of outlet zone P. In outlet zone O and outlet zone P, the vanes 35 in register therewith are in a stowed position within the relevant slots 30 as they follow first contour 50 in the cam surface 25. The first contour 50 of the cam surface 25 in outlet zone P has a constant length radius 55 emanating from axis 20. The area of zones A, B, and C, and the area of zones H, I, J, is minimized and carry compressed fluid, such as air, therein.

Zones D and K form compression zones as the variable vanes 35 move from an extended position relative to the slots 30 to a stowed position while following a diminishing second contour 60 thereby limiting (e.g., diminishing) the area of zones D and K to the same area shown in zones A, B and C forming outlet zone O and zones H, I and J forming outlet zone P respectively. The diminishing second contour 60 has a radius 65 emanating from axis 20 that diminishes from a length of a radius 70 in zone E to the same length of radius 55 as in outlet zones O and P.

Zones F and E and Zones M and L all have the same or similar area and a constant radius 70 following third contour 75 of the cam surface 25.

Zones F and G, and N and M are each in register with a fluid inlet 40. Zones N and G represent expansion areas where the vanes 35 move from a stowed position to an extended position to allow fluid to move therein and the fourth contour 80 which attaches the first contour 50 to the third contour 75. Zones E and L each have the same area as the preceding zones M and F to prevent back flow of fluid from zones E and L to the zones M and F respectively because the pressure in those zones are the same. Zones N and G have an extending arc 85.

As previously mentioned, zones K and D compress in area, thereby compressing the fluid therein, so that the zone C and the corresponding zone J have fluid at the proper pressure to export the pressurized fluid through the outlets even though zones C and J do not align with an outlet 45. If the zones C and J are not fully compressed until they reach zones I and B, then as the vane between B and C or I and J passes the outlet 45 there may be back flow into zones C or J. As zone C moves to zone B and zone J moves to zone I though it is clear that the pressure of the fluid is proper to outlet through the outlets 45 without significant backflow into the zones I or B. By waiting another zone to expel the fluid compressed in zones C or J, the two aft vanes in zones O and P, in essence form a seal to reduce back flow.

Waiting a zone to export the fluid through an outlet 45 after the fluid is compressed, allows a vane compressor 10 to be built without valves for preventing back flow. Similarly, zones A and H are also maintained at the same area as zones B and I, respectively. If zones A and H were allowed to expand in area by allowing the vanes 35 to move outwardly along the cam surface 25 in zones A and H, the drop in pressure in those zones may pull fluid from an outlet 45 through zones I and B respectively causing undesirable back flow from an outlet 45. By waiting a zone, the two forward vanes and the two aft vanes in zones O and P, in essence form a seal to reduce back flow. As a result, by extending the vanes in zones N and M a full zone past an outlet 45, a backflow prevention valve at an outlet 45 is unnecessary.

Functionally, by keeping the area of zones A, B and C substantially constant as they create outlet zone O can prevent the need for back flow valves (not shown). The area in those zones is kept substantially constant herein by maintaining the substantially constant arc in the first contour 50 of the cam surface 25 in those zones. This is also true in outlet zone P which includes zones H, I and J.

Similarly, vanes surrounding zones L and E are kept at a substantially constant distance from the axis 20 to the cam surface 25 as the immediately preceding zones M and F which are in register with the inlets 40. This prevents back flow of fluid as it is compressed in zones K and D to reduce back flowing through the inlet 40 and wasting energy of compressing the fluid.

Although a combination of features is shown in the illustrated examples, not all of them need to be combined to realize the benefits of various embodiments of this disclosure. In other words, a system designed according to an embodiment of this disclosure will not necessarily include all of the features shown in the FIGURE or all of the portions schematically shown in the FIGURE. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A vane compressor comprising:

a disc for rotation about an axis, said disc receiving a plurality of circumferentially spaced vanes movable radially inward and outward of slots in said disc;

a cam surface surrounding said disc, and said cam surface having sections spaced by a plurality of distinct radii from said axis such that as said disc rotates, said vanes are biased into contact with said cam surface, creating a plurality of circumferentially spaced zones, and such that as said disc rotates, a fluid entrapped in said plurality of circumferentially spaced zones is initially allowed into said zones through an inlet, then compressed, then allowed to move outwardly through an outlet; and said cam surface being such that there is an outlet area of constant radius spaced from said central axis and associated with said outlet, and said outlet area of constant radius having a circumferential width such that a zone between a pair of spaced vanes immediately upstream of said outlet will not be further compressed due to said area of constant radius.

2. The vane compressor as set forth in claim 1, wherein due to said area of constant radius, an outlet valve is not needed.

3. the vane compressor as set forth in claim 1, wherein said outlet area of constant radius extends along said cam surface for at least a circumferential distance of three zones such that a zone immediately downstream of said outlet is also part of said outlet area of constant radius.

4. The vane compressor as set forth in claim 1, wherein an inlet increasing area of said cam surface associated with said inlet has a radius which increases from an upstream end to a downstream end.

5. The vane compressor as set forth in claim 4, wherein said cam surface has an inlet area of constant radius immediately downstream of said inlet increasing area, and said inlet area of constant radius extending circumferentially for at least two zones.

6. The vane compressor as set forth in claim 5, wherein there is a compression zone through which the cam surface has a decreasing radius, and located downstream of said inlet area of constant radius.

7. The vane compressor as set forth in claim 1, wherein across the circumference of said vane compressor there are two outlets, two inlets, and each of said outlets having said outlet area of constant radius.

* * * * *